US005903792A

United States Patent [19]

Piccinino, Jr. et al.

[11] Patent Number: 5,903,792

[45] Date of Patent: May 11, 1999

[54] PHOTOGRAPHIC PROCESSOR HAVING AN EXTERNALLY CONTROLLED HEAT EXCHANGE SYSTEM

[75] Inventors: Ralph L. Piccinino, Jr., Rush; John H. Rosenburgh, Hilton, both of N.Y.

[73] Assignee: Eastman Kodak Company, Rochester, N.Y.

[21] Appl. No.: 09/005,805

[22] Filed: Jan. 12, 1998

[51] Int. Cl.[6] ..... G03D 13/00

[52] U.S. Cl. ..... 396/571; 396/573

[58] Field of Search ..... 396/571–573, 396/636, 626, 622, 624, 578

[56] References Cited

U.S. PATENT DOCUMENTS

| | | | |
|---|---|---|---|
| 3,388,653 | 6/1968 | Mayfield | 396/572 |
| 3,922,701 | 11/1975 | Geyken et al. | 396/572 |
| 4,035,818 | 7/1977 | King | 396/626 |
| 4,456,355 | 6/1984 | Kaufmann et al. | 396/572 |
| 4,994,837 | 2/1991 | Samuels et al. | 396/578 |
| 5,027,145 | 6/1991 | Samuels | 396/573 |
| 5,649,261 | 7/1997 | Schlickhoff et al. | 396/571 |

*Primary Examiner*—D. Rutledge
*Attorney, Agent, or Firm*—Peyton C. Watkins

[57] ABSTRACT

A processing apparatus for processing of a photographic material, the apparatus comprises a first processing tank containing a first processing solution; a second processing tank containing a second processing solution; and a heat exchange system having a heat exchange fluid, which is independent of the first and second solutions and a temperature of which is controlled independent of the first and second solutions, for cooling of the first processing solution contained in the first processing tank and heating of the processing solution contained in the second processing tank.

10 Claims, 4 Drawing Sheets

PHOTOGRAPHIC PROCESSOR HAVING AN EXTERNALLY CONTROLLED HEAT EXCHANGE SYSTEM

FIELD OF THE INVENTION

The invention relates to the field of photography and, more particularly, to a photosensitive material processing apparatus.

BACKGROUND OF THE INVENTION

The processing of photosensitive material involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

Typically large photofinishing apparatus and microlabs utilize fixed and integrated horizontal and vertical arrangements of racks and tanks, i.e., the stations. Each station must be maintained at predetermined temperatures for permitting proper processing at that particular station. The first station into which the photographic paper enters is typically the developer which requires the variance of the temperature to be small in comparison with the other stations. The other stations of wider temperature variance usually function as a heat sink for the developer, which has a tendency to overheat. To cool the developer for maintaining the desired temperature, some of its processing solution is suctioned into a heat exchange conduit which passes through the other stations for heating the other stations and cooling the developer, such as that disclosed in U.S. Pat. No. 4,994,837.

Although the above-described system and method for heat exchange is satisfactory, it is not without drawbacks. The heat exchange is obviously constrained by the fluid temperature passing through the heat exchanger which is not controlled independent of the temperature of the processing solutions in the developer station. Consequently, a need exists for a thermal control arrangement that overcomes the above-described drawbacks.

SUMMARY OF THE INVENTION

The present invention is directed to overcoming one or more of the problems set forth above. Briefly summarized, according to one aspect of the present invention, the invention resides in a processing apparatus for processing of a photographic material, said apparatus comprising: (a) a first processing tank containing a first processing solution; (b) a second processing tank containing a second processing solution; and (c) a heat exchange system having a heat exchange fluid, a temperature of which fluid is controlled dependent on a temperature of the first solution for cooling of said first processing solution contained in the first processing tank and heating of said processing solution contained in said second processing tank without directly contacting one or more of the processing solutions.

It is an object of the present invention to provide a heat exchange system whose temperature is controlled independently of the temperature of certain processing solutions.

It is an advantage of the present invention to provide a closed-loop system for passing the heat exchange fluid through the processing tanks.

It is a feature of the present invention to provide a heat exchange system having a heat exchange fluid, a temperature of which fluid is controlled dependent on a temperature of the first solution, for cooling of the first processing solution contained in the first processing tank and heating of the processing solution contained in the second processing tank.

The above and other objects of the present invention will become more apparent when taken in conjunction with the following description and drawings wherein identical reference numerals have been used, where possible, to designate identical elements that are common to the figures.

ADVANTAGEOUS EFFECT OF THE INVENTION

The present invention has the advantage of having the heat exchange fluid, and consequently its temperature, controlled independent of the temperatures of the processing solutions in the stations.

DETAILED DESCRIPTION OF THE INVENTION

Figure 1:
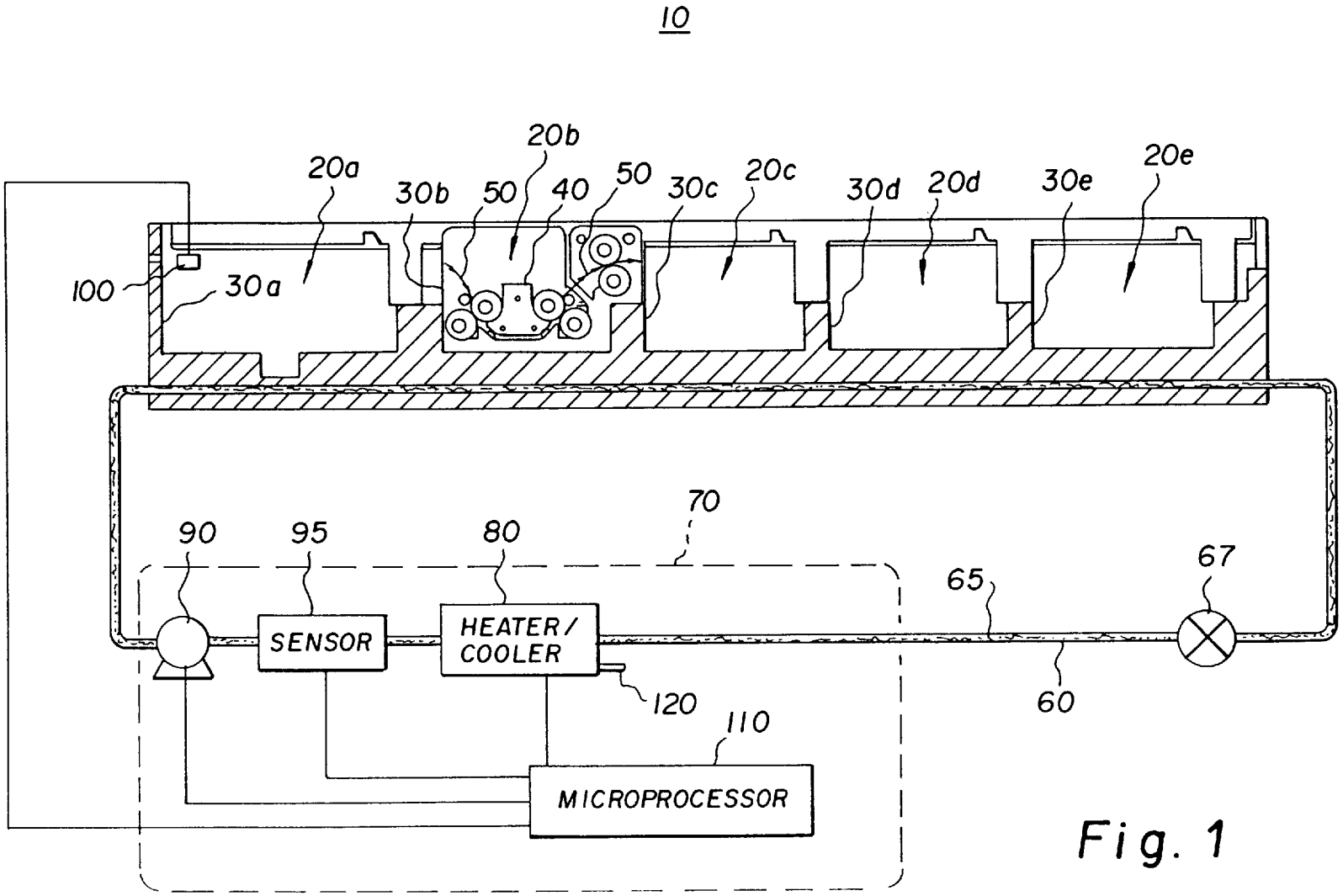
FIG. 1 is a side view in vertical cross section of the processor of the present invention with portions removed for clarity.
Figure 2:
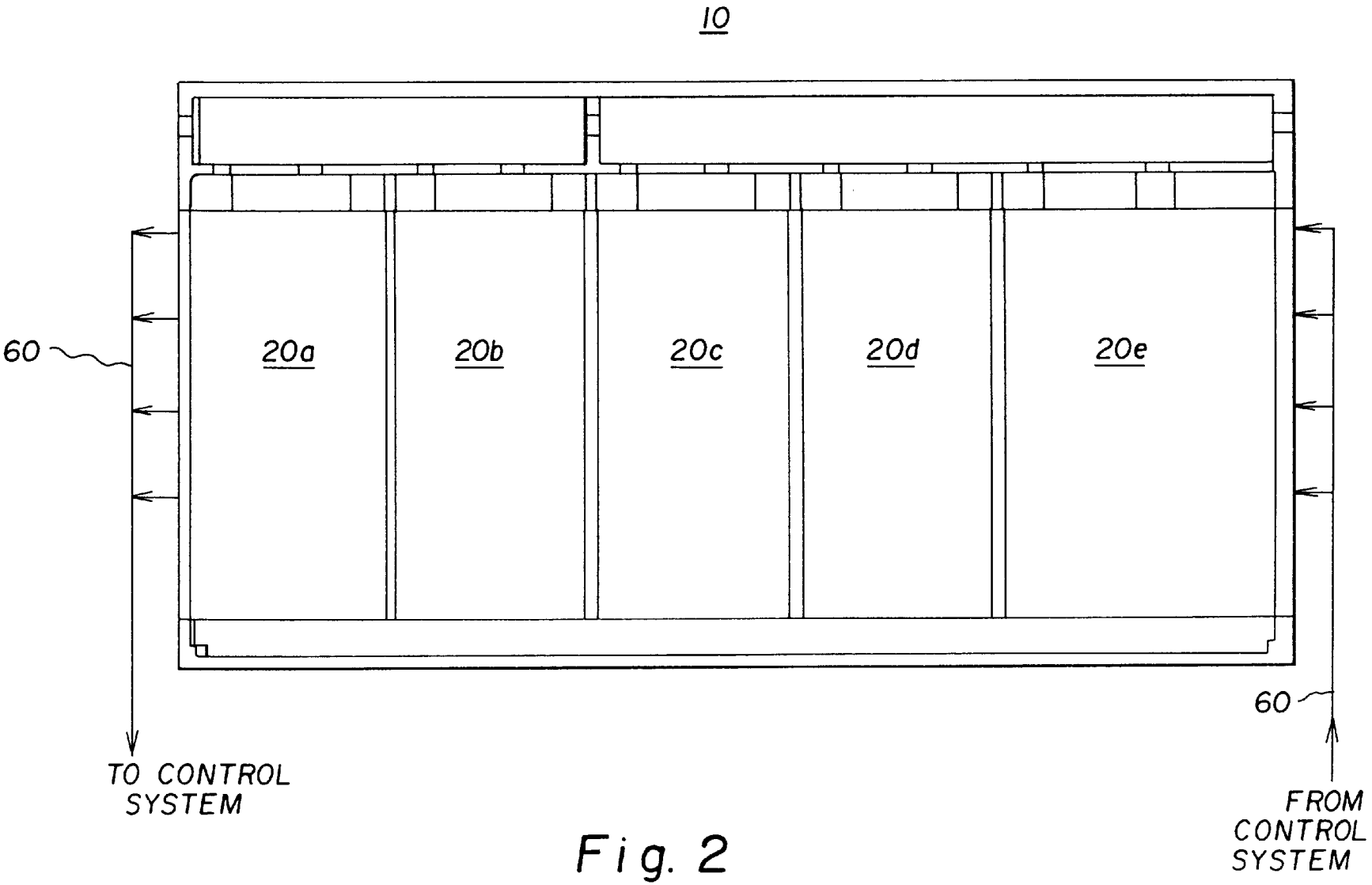
FIG. 2 is a top view in horizontal cross section of the processor with portions removed for clarity.

Referring to FIGS. 1 and 2, a processing module 10 is illustrated having a plurality of processing stations 20. Each station 20 includes a hollowed-out tank 30 that contains the processing solution for that particular tank. A rack 40 is respectively positioned in each tank (only one rack is shown for clarity) for passing the photographic material 50 through the solution in the tank; the process of passing the photographic material through the stations is well known in the art and will not be discussed in detail herein as it is not necessary for understanding the present invention.

A closed-loop heat exchange conduit 60 is disposed through a lower portion of the processing module 10 for permitting either cooling or heating of the processing solution in the stations. It should be understood that this conduit 60 may be disposed at different locations within the module 10 so as to suit the physical design and shape constraints. The conduit 60 includes a heat exchange fluid 65 therein, typically water, that is injected into the conduit 60 via a fluid control system 70 located external to the processing module 10. The control system 70 includes a heater/cooler 80 therein for permitting either heating or cooling of the heat exchange fluid, a pump 90 for pumping the heat exchange fluid therethrough, and a sensor 95 for sensing the temperature of the heat exchange fluid 65. Such heaters/coolers 90 are well known in the art and will not be discussed in detail herein. The conduit 60 and control system 70 form a closed-loop, heat-exchange circulation system for the processing module 10.

A valve 67 is disposed in the conduit 60 for permitting the heat exchange fluid 65 to be initially inserted into the conduit 60 and to be replaced as necessary.

A sensor 100 is positioned in the first station, typically the developer 20*a,* for sensing the temperature of the particular solution therein. The sensor 100 is electrically connected to a microprocessor 110, which is also electrically connected to the heater/cooler 80, pump 90, and sensor 95. The microprocessor 110 controls the operation of the control system 70 and, more particularly, in one of its functions, monitors the temperature of the solution in the developer 30*a* via the sensor 100, and sends a signal to the microprocessor 110 to either heat or cool the solution when the temperatures are not within a predetermined range to which the microprocessor is pre-programmed. The sensor 95 monitors the temperature of the heat exchange fluid 60 from which temperature the microprocessor 110 determines if any heating or cooling is necessary to bring the heat exchange fluid 65 within the desired range. Such temperature ranges are readily achieved by those skilled in the art. Alternatively, a manual override switch 120 is provided for overriding the signals from the microprocessor 110 so that local manual control of heating and cooling the fluid is permitted.

It is instructive to note that, as previously stated, the first station, the developer 20*a,* will typically have a narrower operational temperature range than the other stations 20*b*–20*e,* and that the tendency of the developer 20*a* is to overheat. The other stations 20*b*–20*e* typically have a wider operational temperature range and normally do not require external temperature modulation from the control system 70, and consequently, can function as a heat sink for the developer 20*a* due to its wider temperature tolerance. It also facilities understanding to note that the rate of flow of the heat exchange fluid 65 through the conduit 60 also functions to control the heat exchange rate; this flow rate is controlled by the pump 90. The microprocessor 110 is pre-programmed to control the flow rate for achieving the desired flow. Such flow rates are well known in the art.

Figure 3:
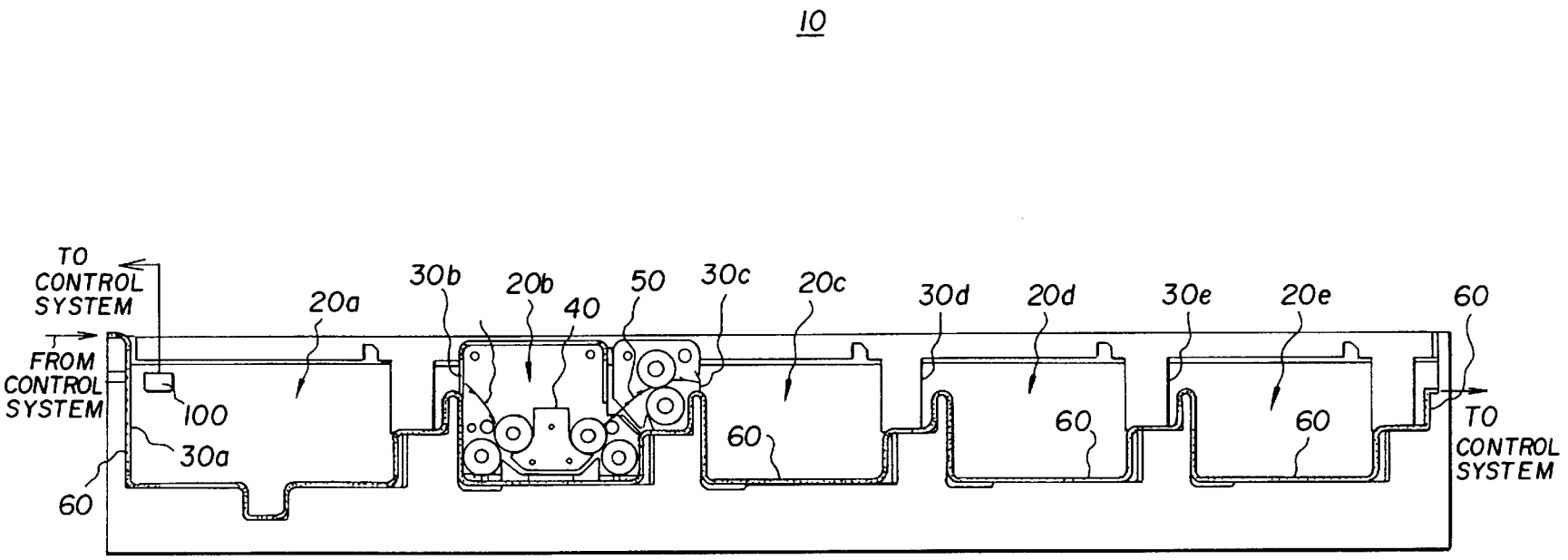
FIG. 3 is side view in vertical cross section of an alternative embodiment of the processor of the present invention with portions removed for clarity.
Figure 4:
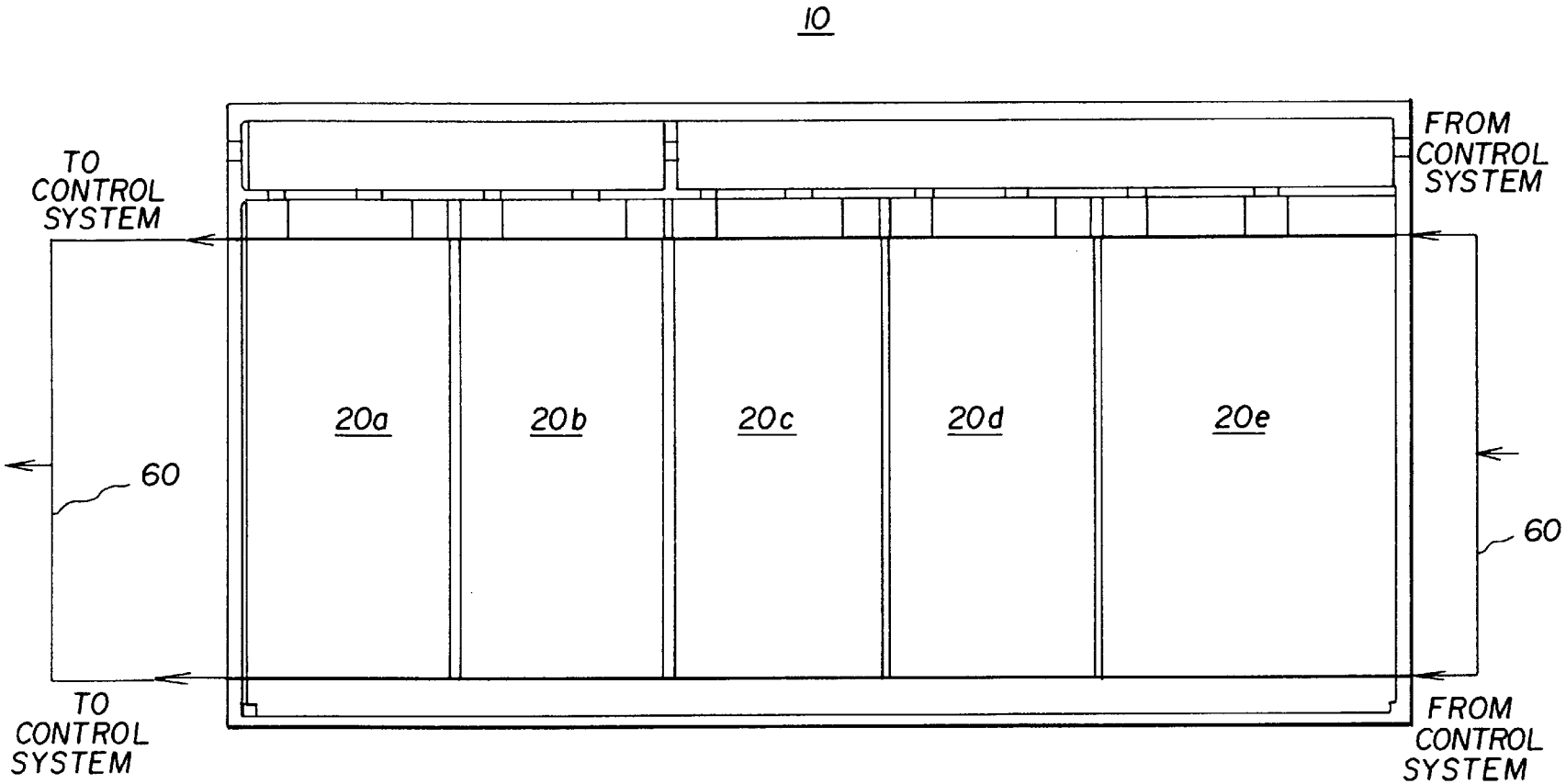
FIG. 4 is a top view in horizontal cross section of an alternative embodiment of the processor with portions removed for clarity.

Referring to FIGS. 3 and 4, alternatively, the conduit 60 preferably passes into an open space portion at the lower portion of the developer 20*a* and through the wall connecting the developer 20*a* and the adjoining station 20*b*. This weaving of the conduit 60 is sequentially continued through all the stations 20*b*–20*e*.

The operation of the processing module 10 is as follows. The sensor 100 in the developer 20*a* sends a signal to the microprocessor 110 when the temperature of the developer solution is not within the predetermined range, which is typically that the temperature is too hot. The control system 70 receives the signal via the microprocessor 110, which will send a signal to the heater/cooler 80 if the temperature of the fluid 65 is not already within the desired range for either heating or cooling the fluid 65. The pump 90 then initiates pumping the fluid 65 through the conduit 60 for providing a heat exchange system for the processing module 10. The flow rate of the fluid 65 may also be varied by the microprocessor 110 via the pump 90 for assisting the heat exchange process.

The invention has been described in detail with particular reference to certain preferred embodiments thereof, but it will be understood that variations and modifications can be effected within the spirit and scope of the invention.

What is claimed is:

1. A processing apparatus for processing of a photographic material, said apparatus comprising:

(a) a first processing tank containing a first processing solution;

(b) a second processing tank containing a second processing solution; and (c) a heat exchange system having a heat exchange fluid, a temperature of which fluid is controlled dependent on a temperature of the first solution for cooling of said first processing solution contained in the first processing tank and heating of said processing solution contained in said second processing tank without directly contacting one or more of the processing solutions.

2. The apparatus as in claim 1, wherein said heat exchange system includes means for either heating or cooling the heat exchange fluid.

3. The apparatus as in claim 2 further comprising means for moving the heat exchange fluid between the first and second tanks.

4. The apparatus as in claim 3, wherein the heat exchange system is a closed-circulation loop.

5. The apparatus as in claim 1 further comprising a plurality of third tanks between which the heat exchange fluid passes.

6. The apparatus as in claim 1, wherein the heat exchange fluid is water.

7. A method of processing of a photographic material, the method comprising the steps of:

(a) providing a first processing solution;

(b) providing a second processing solution; and (c) providing a heat exchange system having a heat exchange fluid, a temperature of which fluid is controlled dependent on a temperature of the first solution for cooling of the first processing solution and heating of the second processing solution without directly contacting one or more of the processing solutions.

8. The method as in claim 7, wherein providing the heat exchange system includes providing means for either heating or cooling the heat exchange fluid.

9. The method as in claim 8 further comprising the step of providing means for moving the heat exchange fluid between the first and second tanks.

10. The method as in claim 9 further comprising a plurality of third solutions between which the heat exchange fluid is passed.

* * * * *